US011987890B1

(12) United States Patent
Greene

(10) Patent No.: US 11,987,890 B1
(45) Date of Patent: May 21, 2024

(54) METHODS AND APPARATUS TO CASE HARDEN TITANIUM ALLOYS

(71) Applicant: The Boeing Company, Arlington, VA (US)

(72) Inventor: Joseph M. Greene, Wallingford, PA (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 18/163,644

(22) Filed: Feb. 2, 2023

(51) Int. Cl.
*C23C 8/30* (2006.01)

(52) U.S. Cl.
CPC ..... *C23C 8/30* (2013.01)

(58) Field of Classification Search
CPC .... C23C 8/20; C23C 8/30; C23C 8/22; C23C 8/00; C23C 8/28; C23C 8/32
See application file for complete search history.

(56) References Cited

U.S. PATENT DOCUMENTS 7,267,793 B2 * 9/2007 Poor ..... C21D 1/773 266/252
11,492,691 B2 11/2022 Greene
2015/0159259 A1 * 6/2015 Moyer ..... C22C 38/20 148/319

* cited by examiner

*Primary Examiner* — Jessee R Roe
(74) *Attorney, Agent, or Firm* — HANLEY, FLIGHT & ZIMMERMAN, LLC

(57) ABSTRACT

Methods and apparatus to case harden titanium alloys are disclosed. A disclosed example method for case hardening a substrate including titanium comprises providing the substrate to a chamber; evacuating the chamber to achieve a vacuum therein, heating the substrate, providing a process gas to the chamber to diffuse hydrogen and a case hardening addition into the substrate, and evacuating the chamber to cause at least a portion of the hydrogen to diffuse from the substrate.

17 Claims, 4 Drawing Sheets

METHODS AND APPARATUS TO CASE HARDEN TITANIUM ALLOYS

FIELD OF THE DISCLOSURE

This disclosure relates generally to material processing and, more particularly, to methods and apparatus to case harden titanium alloys.

BACKGROUND

For aircraft applications, parts and/or components at least partially composed of titanium and/or titanium alloys can have a significant advantage in terms of strength-to-weight over other metals. However, the titanium parts may not have sufficient hardness for certain applications and may be prone to galling, scoring, or fretting. Accordingly, surface hardening can be useful to harden exposed surfaces of a titanium part while leaving the underlying "core" properties unaltered.

SUMMARY

An example method for case hardening a substrate that includes titanium comprises providing the substrate to a chamber; evacuating the chamber to achieve a vacuum therein, heating the substrate, providing a process gas to the chamber to diffuse hydrogen and a case hardening addition into the substrate, and evacuating the chamber to cause at least a portion of the hydrogen to diffuse from the substrate.

An example apparatus includes a body defining a chamber to hold a substrate having titanium therein, a heater to heat the chamber, a gas source to provide a process gas to the substrate such that a case hardening addition and hydrogen are absorbed into the substrate, and a vacuum pump to achieve a vacuum in the chamber, the vacuum pump to remove at least a portion of the absorbed hydrogen from the substrate via a vacuum diffusion process.

An example method includes heating a part at least partially composed of titanium, applying a gas having a compound containing (i) hydrogen and (ii) a case hardening addition to the part to diffuse the hydrogen and the case hardening addition into the part, and vacuum diffusing at least a portion of the hydrogen from the part.

Figure 1:
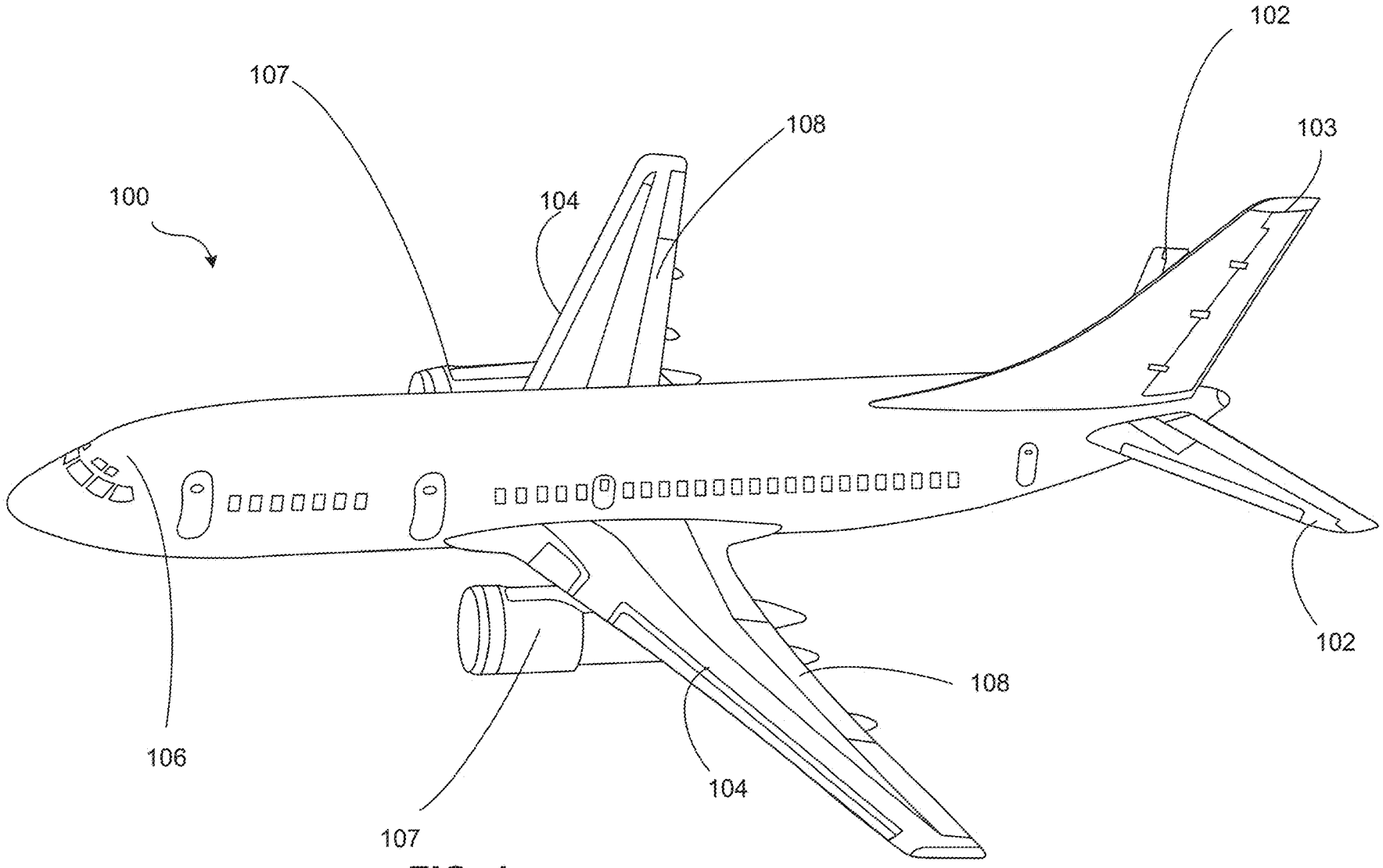
FIG. 1 illustrates an example aircraft in which examples disclosed herein can be implemented.

In general, the same reference numbers will be used throughout the drawing(s) and accompanying written description to refer to the same or like parts. The figures are not to scale. Instead, the thickness of the layers or regions may be enlarged in the drawings. As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another.

As used in this patent, stating that any part is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily imply that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

As used herein, "approximately" and "about" modify their subjects/values to recognize the potential presence of variations that occur in real world applications. For example, "approximately" and "about" may modify dimensions that may not be exact due to manufacturing tolerances and/or other real world imperfections as will be understood by persons of ordinary skill in the art. For example, "approximately" and "about" may indicate such dimensions may be within a tolerance range of +/−10% unless otherwise specified in the below description. As used herein "substantially real time" refers to occurrence in a near instantaneous manner recognizing there may be real world delays for computing time, transmission, etc. Thus, unless otherwise specified, "substantially real time" refers to real time+/−1 second.

DETAILED DESCRIPTION

Method and apparatus to case harden titanium and its alloys are disclosed. For aircraft applications, parts and/or components at least partially composed of titanium alloy can have a significant advantage in terms of strength-to-weight over other metals. However, the titanium parts may not have sufficient hardness for certain applications and, thus, may be prone to galling, scoring, or fretting. Accordingly, surface hardening is typically utilized to harden an exterior of a titanium part while maintaining properties of an inner "core" relatively unaltered.

U.S. patent application Ser. No. 16/522,560, entitled "CASE HARDENED TITANIUM AND METHOD FOR PRODUCING THE SAME," filed on Jul. 25, 2019, granted as U.S. Pat. No. 11,492,691, and hereby incorporated by reference in its entirety, describes exposing a titanium part to cyanogen to case harden the titanium part with carbon and nitrogen. However, the process described in the foregoing U.S. Patent Application can have disadvantages in regard to the use of cyanogen, which has some undesirable properties and, thus, can cause difficulty in manufacturing.

Examples disclosed herein enable highly effective case hardening of titanium parts and/or parts at least partially composed of titanium by utilizing a process gas with hydrogen and a case hardening addition, such as carbon, boron or nitrogen, for example. In particular examples, a hydrocarbon gas is utilized as a process gas for carbon boosting by enabling carbon and hydrogen to diffuse and/or absorb within a titanium part and, in turn, removing at least a portion of the hydrogen from the part via a vacuum diffusion process. Boosting in conjunction with diffusion of the hydrogen can be utilized in controlling surface carbon content. In other words, different parameters of the boosting and diffusion can be utilized to accurately control the surface carbon content.

The application of hydrogen is counterintuitive due to hydrogen having negative impacts to the mechanical properties of titanium and its alloys. However, examples disclosed herein utilize removal of such hydrogen while advantageously utilizing process gases containing hydrogen for effective case hardening diffusion. As a result of utilizing the vacuum diffusion process to remove hydrogen, examples disclosed herein can effectively produce case hardened titanium parts with a relatively low degree of impurities. According to examples disclosed herein, a passive diffusion process is employed to remove hydrogen from the part. In particular, the passive diffusion process can utilize a differential vapor pressure of hydrogen for removal thereof. According to examples disclosed herein, a temperature of the chamber is maintained relatively constant as the hydrogen is removed from the part and/or as the part is exposed to the process gas.

Examples disclosed herein utilize a chamber (e.g., a furnace chamber) that stores and/or contains a part that is at least partially composed of titanium and/or a titanium alloy. In turn, the chamber is purged and/or evacuated such that a vacuum is defined. Subsequently, the titanium part is heated and exposed to a process gas (e.g., a hydrocarbon process gas, a gas containing hydrogen and a case hardening addition/additive, etc.). According to examples disclosed herein, the gas can include hydrocarbon molecules (e.g., a linear hydrocarbon, a cyclic hydrocarbon, acetylene, napthene, methane, propane, etc.) that cause hydrogen and carbon to diffuse onto/into surfaces of the part. An additional vacuum process is utilized to diffuse at least a portion of the hydrogen from and/or out of the part. As a result, the part can then be cooled and removed from the chamber.

In some examples, the chamber and, in turn, the part is heated to approximately 1100-1500 degrees Fahrenheit (° F.). In some such examples, the temperature is maintained in a relatively constant manner (e.g., within +/−10-50° F. of a setpoint temperature) as the process gas is provided to the chamber. In some examples, the part is exposed to the process gas for a time duration equal to or greater than 30 minutes. In some particular examples, the part can be exposed to the process gas for weeks or another relatively significant time duration (e.g., months). While an example range of 1100-1500° F. is proposed based on being in an alpha-beta phase field of Ti-6-4, the most widely used aerospace titanium alloy has a beta transus temperature of approximately around 1825° F. Accordingly, a relatively higher temperature such as above the beta transus is also possible, but significant grain coarsening can result.

As used herein, the terms "titanium part" and "titanium substrate" refer to a part containing or at least partially composed of titanium and/or a titanium alloy. As used here, the term "process gas" refers to a gas utilized to provide case hardening additions to a substrate, part and/or component. As used herein, the terms "evacuation" and "evacuating" refer to utilizing at least a partial vacuum to remove gas and/or molecules from a volume.

FIG. 1 illustrates an example aircraft 100 in which examples disclosed herein can be implemented. In particular, examples disclosed herein can be utilized to produce components and/or parts associated with the aircraft 100, for example. In the illustrated example of FIG. 1, the aircraft 100 includes horizontal tails 102, a vertical tail 103 and wings (e.g., fixed wings) 104 attached to a fuselage 106. The wings 104 of the illustrated example have engines 107, and control surfaces (e.g., flaps, ailerons, tabs, etc.) 108, some of which are located at a trailing edge or a leading edge of the wings 104. The control surfaces 108 may be displaced or adjusted (e.g., deflected, etc.) to provide lift during takeoff, landing and/or flight maneuvers.

In the illustrated example of FIG. 1, internal components and/or assemblies are located in the fuselage 106 (and other external components) of the aircraft 100. These internal components and/or assemblies can utilize materials such as titanium and/or titanium alloys, for example, for their superior strength while remaining relatively light weight. Examples disclosed herein can be implemented for external or internal components of the aircraft 100. Examples disclosed herein can also be applied to any other appropriate implementation and/or application that utilizes materials, such as titanium, titanium alloys and/or titanium-based materials or the like. In particular, nickel and/or nickel super alloys can be processed according to examples disclosed herein. Additionally or alternatively, examples disclosed herein can be utilized to process steel and/or steel alloys. Accordingly, examples disclosed herein can be utilized for rotorcraft (e.g., rotorcraft transmission), bearings, gears, spacecraft, watercraft, submersibles, unmanned aerial vehicles, or stationary structures, etc.

Figure 2:
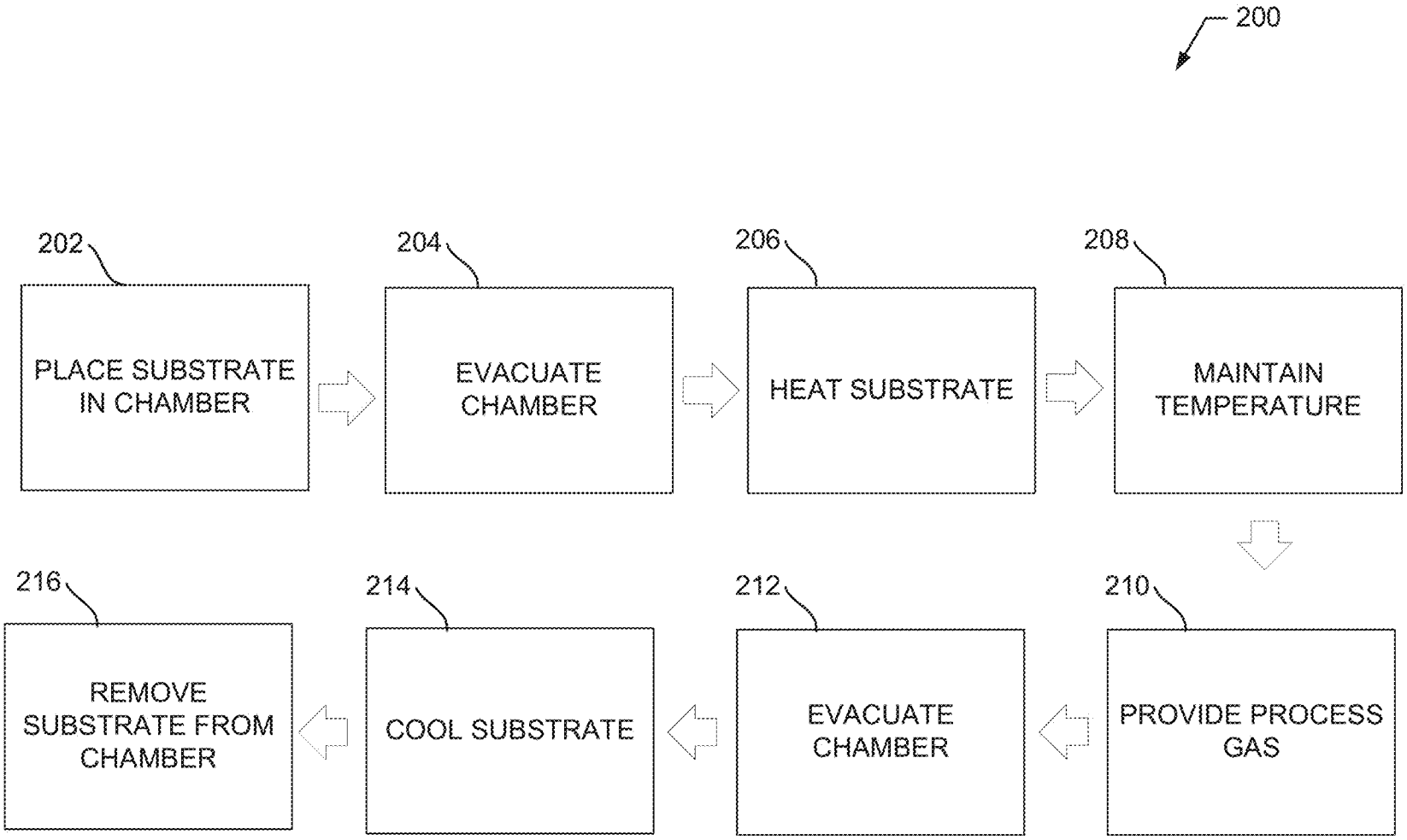
FIG. 2 illustrates an example process flow in accordance with teachings of this disclosure.

FIG. 2 illustrates an example process flow 200 in accordance with teachings of this disclosure. In the illustrated example of FIG. 2, at step 202, a part and/or substrate containing or at least partially composed of titanium (or a titanium alloy) is placed in a body/housing that defines a chamber (e.g., a process chamber, a furnace chamber, an enclosure, a housing and/or body defining a chamber, etc.), such as an example chamber 302 described and shown below in connection with FIG. 3. The substrate can be a part, a workpiece, material, etc.

At step 204, the example chamber is evacuated. In particular, gas in the chamber is evacuated to define at least a partial vacuum that surrounds and/or envelops the substrate.

In this example, at step 206, the chamber is heated to approximately 1100-1500° F. As a result, the substrate is also heated.

At step 208, in some examples, the temperature of the chamber is maintained (e.g., within 5° F.-25° F. of a setpoint temperature, within 10° F. of a setpoint temperature, etc.).

At example step 210, a process gas containing one or more hardening elements (e.g., carbon, boron, etc.) is provided into the chamber with the substrate heated. In this example, the process gas is a hydrocarbon gas that can include acetylene, naphthene, pentane, butane, propane, and/or methane, etc. In some examples, ammonia is utilized (e.g., ammonia is blended with the hydrocarbon gas). Alternatively, instead of blending ammonia with a hydrocarbon, monomethyl amine, dimethyl amine, or similar sources of combined carbon with nitrogen can be implemented instead.

According to some examples, acetylene has been shown to be advantageous in case hardening by having a relatively high carbon activity and a relatively low propensity to produce soot.

At step 212, according to examples disclosed herein, the chamber is evacuated to remove the process gas (e.g., via a vacuum diffusion process), thereby causing at least a portion of the hydrogen deposited onto the substrate to be reduced or substantially removed (e.g. over 90% of the hydrogen is removed). As a result, a significant portion (e.g., all) of the hydrogen is removed from the substrate, which is advantageous in terms of improving (e.g., optimizing) mechanical properties of the substrate. Otherwise, the hydrogen can reduce strength or produce other undesirable effects, such as brittleness. In some examples, the process gas (or a different process gas) is provided to the substrate after at least a portion of the hydrogen is removed. In other words, exposure of the substrate to process gas along with subsequent removal of at least a portion of the hydrogen can be repeated (e.g., based on desired depth penetration of a case hardening addition or a desired overall amount of the case hardening addition). In such examples, the additionally provided process gas (in the repeated process, or alternately boosting with process gas and diffusing in vacuum) can be the same or a different composition (e.g., molecular composition and/or mixture composition, etc.) from the first provided process gas. In some examples, a subsequent or final diffusion of the case hardening addition is performed at a lower temperature than an earlier diffusion of the case hardening addition.

At example step 214, in some examples, the substrate is cooled. The cooling of the substrate can be an active process (e.g., via a fan in a convectional flow or other powered cooler) or a static process by which gas (e.g., air, a cooling gas, a convectional flow gas, etc.) is introduced into the chamber to enable heat to conduct from the substrate to the introduced gas, for example. Additionally or alternatively, the substrate is cooled via a liquid cooler (e.g., the substrate is dropped or placed into water or other liquid quenchant). In some examples, a rate of cooling of the substrate is controlled.

At example step 216, subsequent to cooling of the substrate, the substrate is removed from the chamber.

According to examples disclosed herein, oxygen-bearing species can be reduced and/or minimized, which can include acetone that is used to dissolve and stabilize commercial acetylene that ships in cylinders. Accordingly, maintaining a relatively moderate rate of draw can be performed while maintaining the cylinders at relatively cool temperatures (e.g., out of direct sunlight). Additionally or alternatively, benefits could be obtained from an alternate solvent, such as dimethylformamide (DMF), for example.

In some examples, the process flow 200 occurs at a relatively constant temperature, stepped temperature patterns can be implemented at different steps (e.g., an initial elevation to promote depassivation of surfaces). In some examples, a hard vacuum on the order of $10^{-5}$ torr is preferably utilized to protect the substrate from contamination or oxidation (passivation). A soft vacuum on the order of $10^{-3}$ torr may be achieved by mechanical pumping only, but may not be sufficiently protective of the alloy. In some examples, a preferred temperature is below a beta transus (two-phase field), but can be above the beta transus if grain growth is tolerable.

Figure 3:
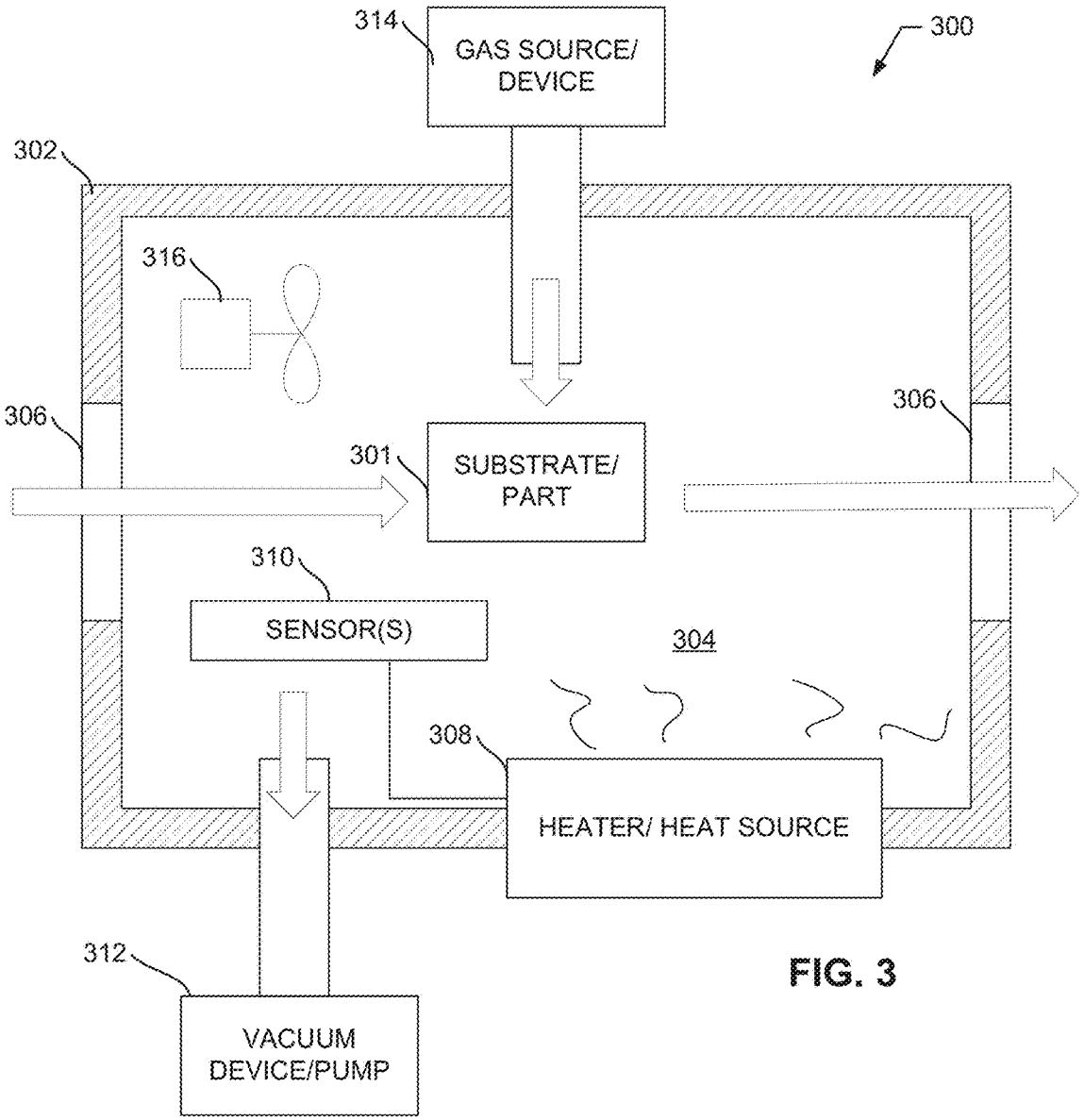
FIG. 3 illustrates an example furnace to implement the example process flow shown in FIG. 2.

FIG. 3 illustrates an example furnace 300 to implement the example process flow 200 shown in FIG. 2. The furnace 300 of the illustrated example is implemented to case harden a substrate (e.g., a part, a component, an assembly, bulk material, an ingot, etc.) 301, which is at least partially composed of titanium and/or a titanium alloy. The example furnace 300 includes the aforementioned chamber 302 that defines and/or includes an inner cavity 304, at least one door 306, a heating device (e.g., a heater, a furnace, a heat source, a burner, etc.) 308, a sensor 310, which can measure temperature and/or pressure, for example, a vacuum pump (e.g., a system of vacuum pumps) 312, and a gas source/injector 314. In some examples, the furnace 300 includes a fan 316 or any other appropriate cooling device, such as, but not limited to, a Peltier device/cooler, a refrigeration device, a water cooler, a spray device, etc.

According to examples disclosed herein, to boost a carbon content of the substrate 301, once the substrate 301 is placed into the cavity 304 via the door 306, the vacuum device 312 evacuates gas from the cavity 304, thereby defining at least a partial vacuum surrounding the substrate 301. In turn, the heating device 308 heats the substrate 301 and/or the cavity 304, and the gas source/injector 314 provides a process gas (e.g., a hydrocarbon process gas) into the cavity 304. In this example, the sensor 310 is utilized to measure a temperature of the substrate 301 and/or the inner cavity 304 to enable the heating device 308 to maintain the temperature at a relatively constant level. As a result, hardening elements (from the process gas) are diffused into the substrate 301. Different parameters related to exposure of the substrate 301 to the hardening elements can be controlled. In particular, case depth and surface hardness can be controlled via combinations of temperature, exposure time to process gases, and the ratio of boosting to diffusing time, for example.

To remove hydrogen (and other impurities), the example vacuum pump 312 is operated to achieve a vacuum to remove the process gas from the cavity 304. In this example, a relatively low vapor pressure of the carbon or other hardening species causes the carbon or other hardening species to remain in the substrate 301 (e.g., on an external surface of the substrate 301). In contrast, the hydrogen is caused to diffuse out of the substrate 301 due to a relatively high vapor pressure of the hydrogen. In some examples, other impurities, such as oxygen, etc., can also be removed from the substrate 301 with the aforementioned vacuum. In some examples, a limit of approximately 100-150 parts per million (ppm) of hydrogen may be utilized in setting removal and/or evacuation parameters of hydrogen.

While the example of FIG. 3 utilizes a process gas that is a hydrocarbon gas, additionally or alternatively, a diborane gas or an ammonia gas (e.g., a pure ammonia gas) can be implemented as a process gas. In some examples, plasma is applied to and/or generated in the process gas. In some examples, a hydrocarbon gas and ammonia are applied to the substrate 301, thereby carbonitriding the substrate 301. In other words, the hydrocarbon gas in combination with ammonia can be utilized to case harden the substrate 301 with dual case hardening elements/additions. Examples disclosed herein can utilize organic compounds and/or analogous compounds (e.g., (ammonia, boranes, methyl amines, cyanide, etc.).

Figure 4:
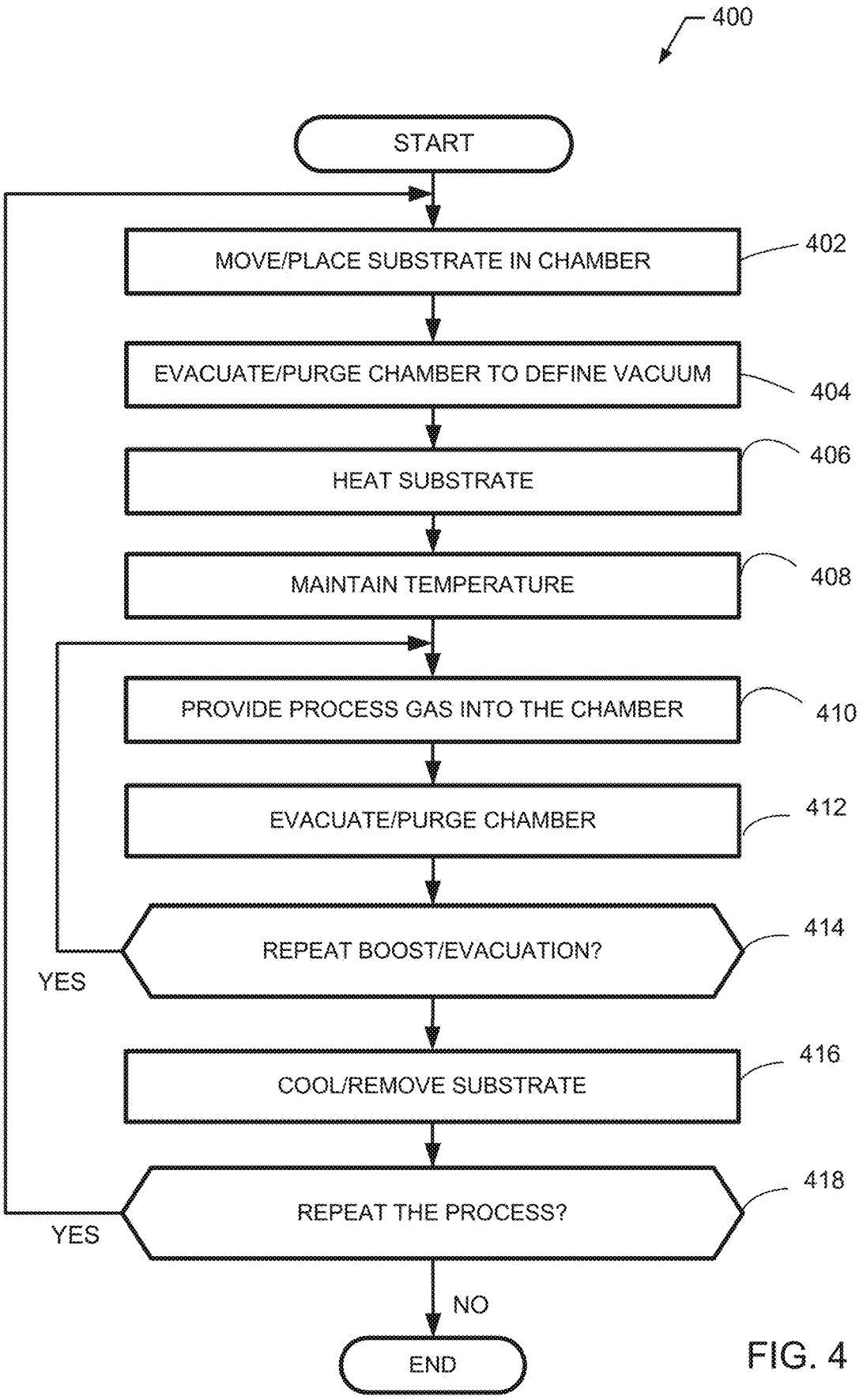
FIG. 4 is a flowchart representative of an example method to implement examples disclosed herein.

FIG. 4 is a flowchart representative of an example method 400 to implement examples disclosed herein. In the illustrated example of FIG. 4, the substrate 301 is to undergo a case hardening process such that carbon (or another case hardening addition) is to be provided to the substrate 301 such that the hardening elements are diffused into a requisite depth of an external surface of the substrate 301. The example method 400 begins at block 402 as the substrate 301 is placed into the chamber 302 (e.g., via the door(s) 306).

At block 404, in this example, the chamber 302 is evacuated and/or purged by the vacuum device 312 to define a vacuum in the chamber 302. In particular, the vacuum can surround and/or envelop the substrate 301 within the chamber 302.

At block 406, the heating device 308 heats the chamber 302 and, in turn, the substrate 301. In this example, the chamber 302 is heated to a suitable temperature to activate the gas and promote diffusion, typically at least approximately 1000° F. However, any other appropriate temperature range and/or setpoint can be implemented instead.

At block 408, in some examples, the heating device 308 maintains a temperature of the chamber 302 at a relatively constant temperature. In this example, the temperature of the chamber 302 is maintained at about the aforementioned setpoint of approximately 1000° F. based on temperature readings from the sensor 310, which can be placed, deployed and/or disposed in the chamber 302. However, any other appropriate temperature measurement can be utilized instead.

At block 410, the gas source/injector 314 provides a process gas to the chamber in a boosting process. In the illustrated example of FIG. 4, the process gas is a hydrocarbon gas that may be introduced in conjunction with ammonia. In some such examples, nitrogen from the ammonia in combination with carbon from the hydrocarbon gas diffuses into the substrate 301, thereby carbonitriding the substrate. In some examples, the hydrocarbon gas is acetylene, which can have favorable properties in enabling diffusion of carbon into the substrate. Additionally or alternatively, boranes can be employed as a boron source (e.g., boriding). In some examples, plasma is provided to the chamber 302 and/or generated (e.g., via ionization) within the process gas. In some examples, the process gas is provided at a pressure of approximately 1 torr to 1000 torr. However, any other appropriate pressure can be implemented instead, especially where inert gas diluent is used to moderate a partial pressure, for example.

In this example, at block 412, the vacuum device 312 evacuates and/or purges the chamber 302, thereby defining a vacuum diffusion process that reduces (e.g., eliminates) the hydrogen and/or impurities from the substrate 301. In some examples, approximately 1 minute of boosting is followed by approximately 3 minutes of vacuum diffusing. However, any other appropriate time durations can be implemented for controlling and improving (e.g., optimizing) results.

At block 414, in some examples, it is determined whether to repeat the boosting of the substrate 301 with case hardening additions, such as carbon, boron and/or nitrogen, etc. followed by a respective evacuation (e.g., a vacuum diffusion) of hydrogen. This determination may be based on whether enough boosting has been applied such that the case hardening addition reaches a desirable depth, surface coverage and/or overall coverage of the substrate 301. If the boosting is to be repeated (block 414) control of the process returns to block 410. Otherwise, the process proceeds to block 416.

At block 416, in some examples, the substrate 301 is cooled. The cooling of the substrate may be active (e.g., by utilizing a fan, a Peltier cooler, a spray system, a liquid cooling system, etc.) or inactive (e.g., via gas conduction). According to examples disclosed herein, cooling can be employed via inert gas, which can be either static or recirculated by a fan (e.g., in forced gas cooling).

At block 418, it is determined whether to repeat the process. If the process is to be repeated (block 418), control of the process returns to block 402. Otherwise, the process ends. This determination may be based on whether additional parts and/or components are to be case hardened.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

Example methods, apparatus, systems, and articles of manufacture to enable case hardening of metals with effective diffusion of case hardening additions are disclosed herein. Further examples and combinations thereof include the following:

Example 1 includes a method for case hardening a substrate including titanium, the method comprising providing the substrate to a chamber, evacuating the chamber to achieve a vacuum therein, heating the substrate, providing a process gas to the chamber to diffuse hydrogen and a case hardening addition into the substrate, and evacuating the chamber to cause at least a portion of the hydrogen to diffuse from the substrate.

Example 2 includes the method as defined in example 1, wherein the process gas includes a linear hydrocarbon.

Example 3 includes the method as defined in any of examples 1 or 2, wherein the process gas includes a cyclic hydrocarbon.

Example 4 includes the method as defined in any of examples 1 to 3, further including cooling the substrate after providing the process gas to the chamber.

Example 5 includes the method as defined in example 4, wherein cooling the substrate includes introducing a cooling gas into the chamber to cool the substrate Example 6 includes the method as defined in any of examples 1 to 5, further including providing ammonia to the substrate with the process gas to diffuse nitrogen into the substrate.

Example 7 includes the method as defined in any of examples 1 to 6, wherein the process gas is a first process gas, and further including providing a second process gas having at least one of a hydrocarbon gas or gaseous boron to the substrate after evacuating the first process gas, and evacuating the second process gas from the chamber.

Example 8 includes the method as defined in example 7, wherein the first process gas has a different composition from the second process gas.

Example 9 includes an apparatus comprising a body defining a chamber to hold a substrate having titanium therein, a heater to heat the chamber, a gas source to provide a process gas to the substrate such that a case hardening addition and hydrogen are absorbed into the substrate, and a vacuum pump to achieve a vacuum in the chamber, the vacuum pump to remove at least a portion of the absorbed hydrogen from the substrate via a vacuum diffusion process.

Example 10 includes the apparatus as defined in example 9, wherein the gas source is to further provide at least one of ammonia or diborane to the substrate.

Example 11 includes the apparatus as defined in any of examples 9 or 10, further including a sensor to measure a temperature of the chamber.

Example 12 includes the apparatus as defined in example 11, wherein the heater is to maintain the temperature of the chamber relatively constant as the process gas is provided to the substrate based on information from the sensor.

Example 13 includes the apparatus as defined in any of examples 9 to 12, wherein the gas source is to repeatedly provide the process gas in response to the vacuum pump removing the hydrogen.

Example 14 includes a method comprising heating a part at least partially composed of titanium, applying a gas having a compound containing (i) hydrogen and (ii) a case hardening addition to the part to diffuse the hydrogen and the case hardening addition into the part, and vacuum diffusing at least a portion of the hydrogen from the part.

Example 15 includes the method as defined in example 14, wherein the case hardening addition includes at least one of carbon, boron or nitrogen.

Example 16 includes the method as defined in any of examples 14 or 15, wherein the gas includes acetylene.

Example 17 includes the method as defined in any of examples 14 to 16, wherein the heating the part includes heating the part to at least 1000 degrees Fahrenheit (° F.).

Example 18 includes the method as defined in any of examples 14 to 17, further including providing cooling gas to a chamber containing the part to cool the part via some combination of conduction, radiation & convection.

Example 19 includes the method as defined in any of examples 14 to 18, further including repeating the applying the gas to increase a diffused amount of the case hardening addition in the part.

Example 20 includes the method as defined in any of examples 14 to 19, further including generating a vacuum surrounding the part.

From the foregoing, it will be appreciated that example systems, methods, apparatus, and articles of manufacture have been disclosed that enable effective diffusion of case hardening additions into titanium parts/substrates by utilizing process gasses that include hydrogen along with a case hardening addition in combination with effective removal of the hydrogen. Thus, examples disclosed herein can produce parts, components and/or materials with highly desirable properties (e.g., increased strength and durability, resistance to galling, scoring, and/or fretting, improved tribological properties, etc.).

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. A method for case hardening a substrate including titanium, the method comprising:

providing the substrate to a chamber;

evacuating, via a first vacuum process, the chamber to achieve a vacuum therein;

heating the substrate;

providing a process gas to the chamber to diffuse hydrogen and a case hardening addition into the substrate; and evacuating, via a second vacuum process, the chamber to achieve a vacuum to vacuum diffuse at least a portion of the hydrogen from the substrate.

2. The method as defined in claim 1, wherein the process gas includes a linear hydrocarbon.

3. The method as defined in claim 1, wherein the process gas includes a cyclic hydrocarbon.

4. The method as defined in claim 1, further including cooling the substrate after providing the process gas to the chamber.

5. The method as defined in claim 4, wherein cooling the substrate includes introducing a cooling gas into the chamber to cool the substrate.

6. The method as defined in claim 1, further including providing ammonia to the substrate with the process gas to diffuse nitrogen into the substrate.

7. The method as defined in claim 1, wherein the process gas is a first process gas, and further including:

providing a second process gas having at least one of a hydrocarbon gas or gaseous boron to the substrate after evacuating the first process gas; and evacuating the second process gas from the chamber.

8. The method as defined in claim 7, wherein the first process gas has a different composition from the second process gas.

9. The method as defined in claim 1, wherein a first temperature of the second vacuum process is lower than a second temperature of the first vacuum process.

10. The method as defined in claim 1, wherein the process gas is a first process gas, and further including:

providing a second process gas to the gas chamber in response to completion of the second vacuum process, the second process gas different from the first process gas; and evacuating, via a third vacuum process, the chamber of the second process gas to achieve a vacuum therein.

11. A method comprising:

heating a part at least partially composed of titanium in a chamber;

evacuating, via a first vacuum process, the chamber to achieve a first vacuum therein;

applying a gas having a compound containing (i) hydrogen and (ii) a case hardening addition to the part to diffuse the hydrogen and the case hardening addition into the part; and vacuum diffusing, via a second vacuum process, at least a portion of the hydrogen from the part by achieving a second vacuum in the chamber.

12. The method as defined in claim 11, wherein the case hardening addition includes at least one of carbon, boron or nitrogen.

13. The method as defined in claim 11, wherein the gas includes acetylene.

14. The method as defined in claim 11, wherein the heating the part includes heating the part to at least approximately 1000 degrees Fahrenheit (° F.).

15. The method as defined in claim 11, further including providing cooling gas to a chamber containing the part to cool the part.

16. The method as defined in claim 11, further including repeating the applying the gas to increase a diffused amount of the case hardening addition in the part.

17. The method as defined in claim 11, wherein the vacuum of the second vacuum process surrounds the part.

* * * * *